US010625335B2

(12) United States Patent
Fujikawa

(10) Patent No.: US 10,625,335 B2
(45) Date of Patent: Apr. 21, 2020

(54) MELTING DEVICE

(71) Applicant: Sodick Co., Ltd., Kanagawa (JP)

(72) Inventor: Misao Fujikawa, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 46 days.

(21) Appl. No.: 15/726,389

(22) Filed: Oct. 6, 2017

(65) Prior Publication Data

US 2018/0117671 A1 May 3, 2018

(30) Foreign Application Priority Data

Oct. 27, 2016 (JP) ..... 2016-210503

(51) Int. Cl.

| | |
|---|---|
| ***B22D 17/28*** | (2006.01) |
| ***B22D 17/30*** | (2006.01) |
| ***B22D 17/10*** | (2006.01) |
| ***B22D 41/015*** | (2006.01) |
| ***B22D 23/06*** | (2006.01) |
| ***F27B 3/08*** | (2006.01) |
| ***F27D 7/06*** | (2006.01) |
| ***F27B 3/22*** | (2006.01) |
| ***B22D 45/00*** | (2006.01) |
| ***F27D 3/15*** | (2006.01) |

(52) U.S. Cl.

CPC ..... *B22D 17/30* (2013.01); *B22D 17/10* (2013.01); *B22D 17/28* (2013.01); *B22D 45/00* (2013.01); *F27B 3/08* (2013.01); *F27B 3/22* (2013.01); *F27D 3/1509* (2013.01); *F27D 3/1536* (2013.01); *F27D 7/06* (2013.01)

(58) Field of Classification Search

CPC ..... B22D 17/00; B22D 17/28; B22D 17/30; B22D 23/06; B22D 41/015; B22D 45/00; B22D 17/10; F27D 7/06

USPC ..... 164/66.1, 259, 303, 312, 335, 337

See application file for complete search history.

(56) References Cited

U.S. PATENT DOCUMENTS

| | | | | |
|---|---|---|---|---|
| 5,563,903 | A | 10/1996 | Jebrail et al. | |
| 5,669,434 | A * | 9/1997 | Nakao et al. | C22C 1/1036 164/97 |
| 2002/0124988 | A1* | 9/2002 | Takizawa et al. | B22D 17/007 164/312 |

(Continued)

FOREIGN PATENT DOCUMENTS

| | | |
|---|---|---|
| CN | 1143684 | 2/1997 |
| CN | 101107370 | 1/2008 |
| JP | 2004-195527 | 7/2004 |

OTHER PUBLICATIONS

Office Action of China Counterpart Application, with English translation thereof, dated Apr. 22, 2019, pp. 1-12.

*Primary Examiner* — Kevin P Kerns
(74) *Attorney, Agent, or Firm* — JCIPRNET

(57) ABSTRACT

There is provided a melting device including a melting cylinder that is heated to a predetermined temperature, melts a molding material supplied from a material supply port, and generates a molten material; an inert gas supply device configured to supply an inert gas onto a melting surface of the molten material and form an inert gas layer; and a low specific gravity gas supply device configured to supply a low specific gravity gas which is a gas having a different type from the inert gas and form a low specific gravity gas layer on the inert gas layer, wherein the low specific gravity gas layer has a lower specific gravity than the inert gas layer.

10 Claims, 4 Drawing Sheets

(56) References Cited

U.S. PATENT DOCUMENTS

| | | | | |
|---|---|---|---|---|
| 2006/0243414 | A1* | 11/2006 | Takizawa et al. ... | B22D 17/007<br>164/113 |
| 2007/0295166 | A1 | 12/2007 | Sanui et al. | |

* cited by examiner

MELTING DEVICE

CROSS-REFERENCE TO RELATED APPLICATION

This application claims the priority benefit of Japan application serial no. 2016-210503, filed on Oct. 27, 2016. The entirety of the above-mentioned patent application is hereby incorporated by reference herein and made a part of this specification.

BACKGROUND OF THE INVENTION

Field of the Invention

The present invention relates to a melting device. Specifically, the present invention relates to a melting device in an injection molding machine suitable for injection molding in which a molding material is a light metal.

Description of Related Art

A molding method in which a molding material is melted and injected into a mold or the like and is shaped into a desired product shape is known, for example, as injection molding. In such a molding method, a molding material may react with substances in the air which come in contact therewith during melting, and cause deterioration. For example, when the molding material is magnesium alloy or aluminum alloy, the molding material may react with oxygen and nitrogen in the air and an oxide and a nitride may be generated. In addition, when the molding material is magnesium alloy, the molding material may react with oxygen and a combustion reaction may be caused.

Therefore, as disclosed in Patent Document 1, a melting device configured to supply an inert gas that does not substantially react with a molten material into the device in order to prevent the molding material from being in direct contact with air during melting and form an inert gas layer including an inert gas on a melting surface of the molten material is known.

PRIOR ART DOCUMENT

Patent Document

[Patent Document 1] Japanese Unexamined Patent Application, No. 2004-195527

SUMMARY OF THE INVENTION

Even if an inert gas is supplied into a melting device, the inert gas is warmed due to heat from the melting device to have a lower specific gravity and convection with external air occurs in an opening such as a material supply port. As a result, the inert gas in the melting device leaks and the concentration of the inert gas gradually decreases. Therefore, it is necessary to refill the inert gas into the melting device regularly. On the other hand, it is preferable that an amount of inert gas used be as small as possible.

The present invention has been made in view of the above circumstances and the present invention provides a melting device which a low specific gravity gas layer is formed on an inert gas layer. The low specific gravity gas layer is generated by a flow of a low specific gravity gas which is a gas having a different type from an inert gas and has a lower specific gravity than the inert gas layer. Since external air is thus prevented from entering, deterioration of a molten material is prevented, and an amount of inert gas used is reduced.

According to the present invention, there is provided a melting device including a melting cylinder that is heated to a predetermined temperature, melts a molding material supplied from a material supply port, and generates a molten material; an inert gas supply device configured to supply an inert gas onto a melting surface of the molten material and form an inert gas layer; and a low specific gravity gas supply device configured to supply a low specific gravity gas which is a gas having a different type from the inert gas and form a low specific gravity gas layer on the inert gas layer, wherein the low specific gravity gas layer has a lower specific gravity than the inert gas layer.

In the injection molding machine including the melting device according to the present invention, a low specific gravity gas layer including a gas having a different type from an inert gas and having a lower specific gravity than an inert gas layer is formed on the inert gas layer. Accordingly, the melted molding material does not come in direct contact with air, and deterioration of the molding material is prevented. Moreover, leakage of the inert gas is prevented due to the low specific gravity gas layer, and it is possible to further reduce an amount of inert gas used.

DESCRIPTION OF THE EMBODIMENTS

Figure 1:
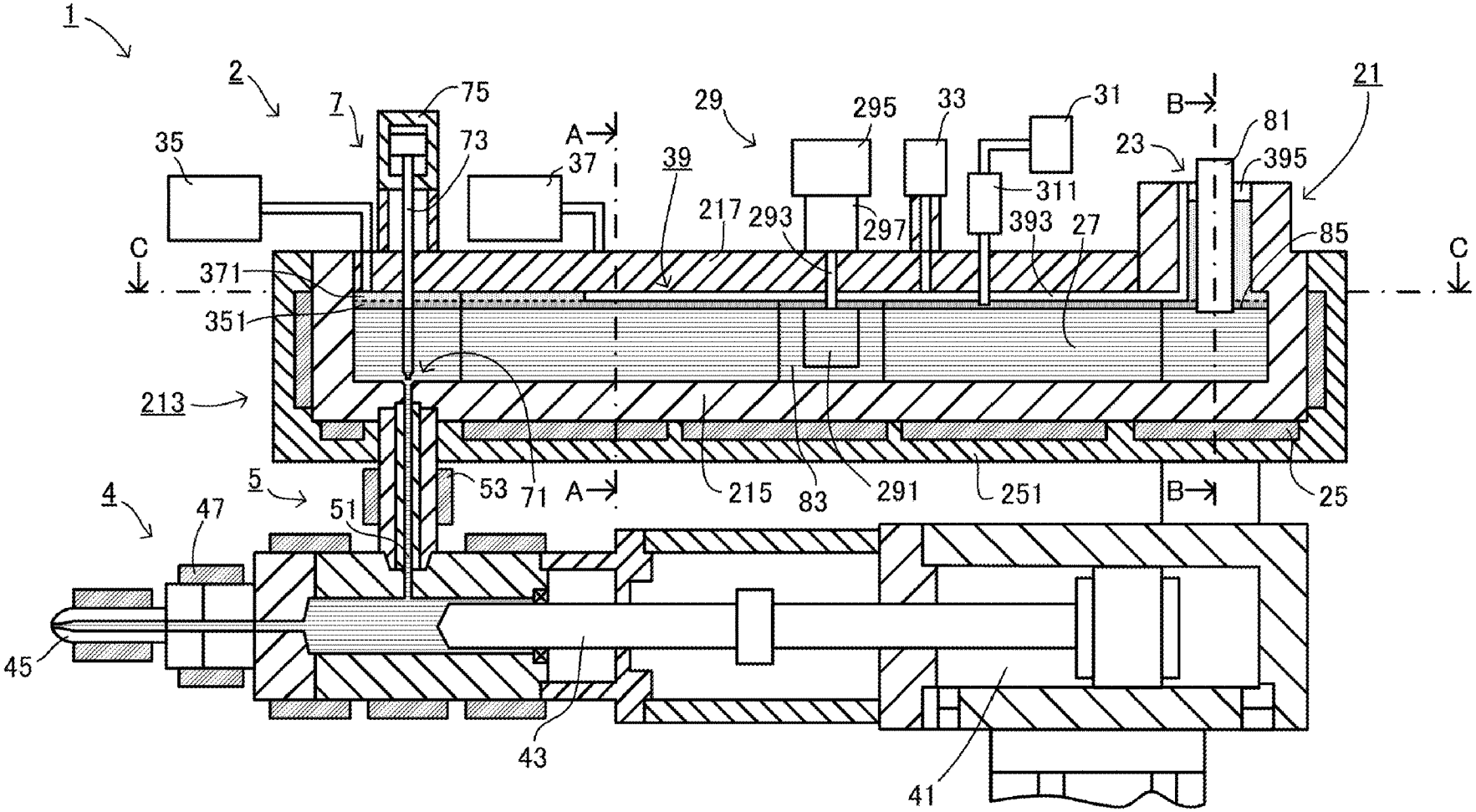
FIG. 1 is a configuration diagram of an injection unit 1 including a melting device 2 of the present invention.

Embodiments of the present invention will be described below with reference to the drawings. Embodiments and examples in which a plurality of components are modified to be described below can be realized in any combination. Here, in the following description, "front end" refers to a side from which a molten material 83 is injected, and specifically, a left side end of a melting device 2 or an injection device 4 in FIG. 1. "Rear end" refers to a side to which a molding material 81 is supplied, and specifically a right side end of the melting device 2 or the injection device 4 in FIG. 1.

An injection molding machine including the melting device 2 according to an embodiment has a structure suitable for injection molding in which the molding material 81 is a light metal. The light metal in the present invention refers to a metal having a specific gravity of 4 or less and includes not only a pure metal but also an alloy containing additional elements. Practically, in particular, a magnesium alloy or an aluminum alloy is effectively used as the molding material 81. Here, when the molding material 81 is an aluminum alloy, parts in contact with the molten material 83 are basically covered with a cermet based material to prevent erosion.

An injection molding machine including the melting device 2 of the present invention mainly includes an injection unit 1 configured to melt the molding material 81 and injects a predetermined amount of the molten material 83 into a cavity of a mold, a clamping unit (not shown) configured to open and close and clamp a mold, and a control unit (not shown) configured to control operations of the injection unit and the clamping unit. The injection unit 1 includes the melting device 2, an injection device 4 and a connecting member 5.

Figure 2:
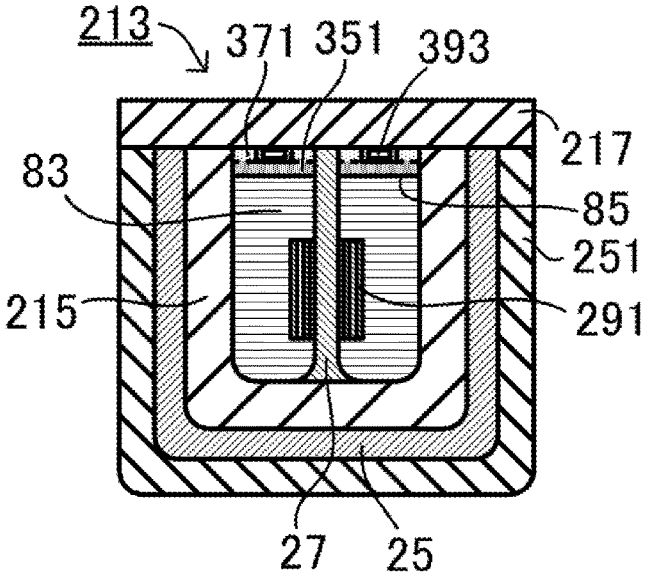
FIG. 2 is a cross-sectional view taken along arrows A-A in FIG. 1.
Figure 3:
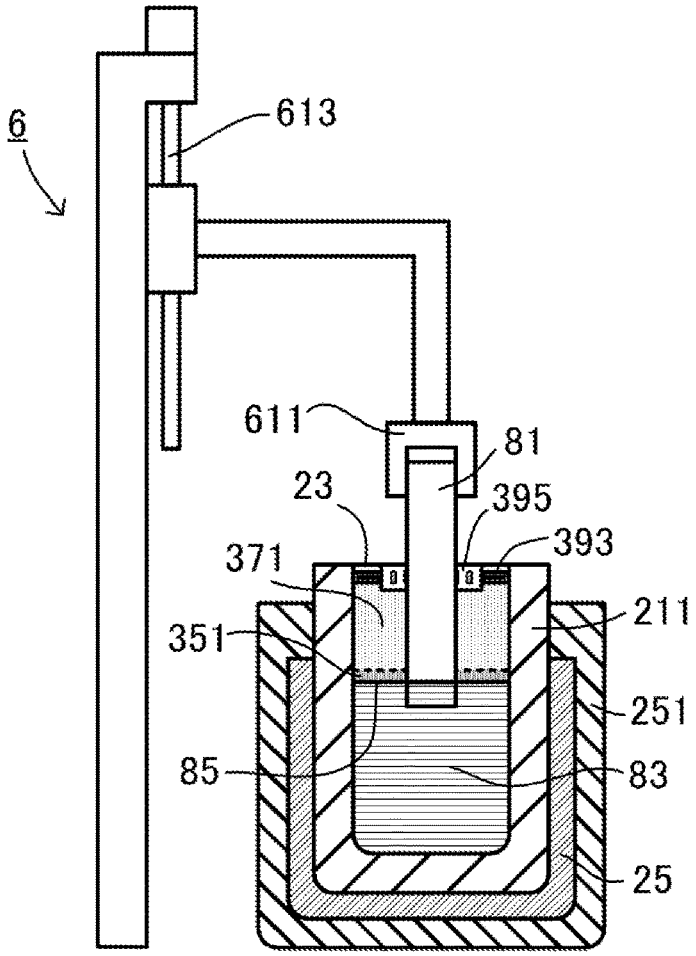
FIG. 3 is a cross-sectional view taken along arrows B-B in FIG. 1 and is a schematic diagram of a material supply device 6.

As shown in FIG. 1, the melting device 2 includes a melting cylinder 21 that is heated to a predetermined temperature, melts the molding material 81, and generates the molten material 83. The melting cylinder 21 includes a vertical cylinder 211 provided on a rear end side of the melting device 2 and a horizontal cylinder 213 that communicates with the vertical cylinder 211 and is provided on a front end side. The horizontal cylinder 213 includes a gutter 215 in which the molten material 83 is stored and a lid 217 that is provided on a top of the horizontal cylinder 213. As shown in FIG. 1 to FIG. 3, the vertical cylinder 211 has an U-shaped cross section and extends in a vertical direction, and the gutter 215 of the horizontal cylinder 213 has an U-shaped cross section and extends in a horizontal direction. A plurality of heaters 25 are respectively provided to come in close contact on the vertical cylinder 211 and the gutter 215 along the U-shape. A heat insulation portion 251 made of an insulation material is provided around the heater 25, and heat from the heater 25 does not escape to the outside, and thus thermal efficiency is improved. The lid 217 is made of an insulation material and is openable or removable. When the lid 217 is opened or removed, maintenance of the melting cylinder 21 is performed easily. In addition, it is preferable that the lid 217 does not come in direct contact with the molten material 83. Here, in this specification, the U-shaped cross section means a shape which includes a pair of side plates and a bottom plate, and in which the side plates and the bottom plate are connected in a curved manner. For example, the U-shaped cross section may be a shape having a substantially semicircular bottom plate, or a shape which side plates and a bottom plate are connected at rounded corners as shown in FIG. 2 and FIG. 3. The heater 25 that is integrated without being divided on the side plates and the bottom surface is easily provided to be in close contact with a cylinder with the U-shaped cross section.

In the vertical cylinder 211, the molding material 81 supplied from a material supply port 23 is heated and melted by the heaters 25, and the molten material 83 is generated and is sent to the horizontal cylinder 213. The molten material 83 sent to the horizontal cylinder 213 is sent forward while it receives sufficient heat from the heater 25, and is sent to the injection device 4 through a communication path 51 of a connecting member 5.

In the melting device 2, a partition plate 27 and a stirrer 29 are provided. The partition plate 27 partitions the inside excluding at least both ends of the melting cylinder 21 and that extends from the side of the rear end to the side of the front end. The stirrer 29 is configured to stir the molten material 83. The stirrer 29 is, for example, a gear pump in which an impeller 291 in the melting cylinder 21 is rotated by a motor 295 through a shaft 293. In such a configuration, a flow of the molten material 83 that circulates around the partition plate 27 is generated and it is possible to prevent the molten material 83 from stagnating. As a result, the temperature of the molten material 83 in the melting cylinder 21 is uniformized, and it is possible to prevent sedimentation and segregation. By only stirring, it is difficult to prevent stagnation in portions other than the vicinity of the stirrer. In particular, when the melting cylinder 21 including the horizontal cylinder 213 that extends in the horizontal direction as in the present example, it is difficult to prevent stagnation in the whole of the horizontal cylinder 213. In the melting device 2 including the horizontal cylinder 213, it is particularly effective to flow the molten material 83 so that it circulates around the partition plate 27. Here, the stirrer 29 may be provided at any position on the melting cylinder 21, but is preferably provided to be spaced a certain distance from the material supply port 23 in order to prevent unmelted molding material 81 from coming in contact with the impeller 291.

Preferably, a torque meter 297 configured to detect a rotational speed and a rotation torque of the motor 295 is provided. When the rotational speed and the rotation torque are measured, it is possible to calculate a viscosity of the molten material 83. Further, it is possible to determine a molten state of the molten material 83 from the type and the viscosity of the molding material 81.

In order to prevent oxidation and nitriding of the molten material 83, an inert gas with a predetermined concentration is filled with on a melting surface 85 of the molten material 83. In particular, when the molding material 81 is a magnesium alloy, since there is a possibility of the molding material reacting with oxygen in the air and burning, supply of an inert gas is very important. In the present embodiment, when an inert gas is supplied from an inert gas supply device 35 into the melting cylinder 21, an inert gas layer 351 including an inert gas with a predetermined concentration is formed on the melting surface 85. The inert gas may be a gas that does not substantially react with the molten material 83, and argon gas is suitable because it has a relatively high specific gravity and is readily available, and is harmless to the human body and the environment. In addition, an atmospheric component measuring device 31 is preferably provided, and is configured to measure an atmospheric component of the inert gas layer 351. The inert gas supply device 35 controls an amount of supplied inert gas so that the inert gas in the inert gas layer 351 has a predetermined concentration according to measurement results of the atmospheric component measuring device 31. The atmospheric component measuring device 31 may be a meter configured to directly measure a concentration of an inert gas or a meter configured to measure an oxygen concentration or a nitrogen concentration. Accordingly, it is possible to supply an inert gas without excess or deficiency. Here, preferably, a cooler 311 is provided between the melting cylinder 21 and the atmospheric component measuring device 31, and the inert gas cooled to some extent through the cooler 311 is measured by the atmospheric component measuring device 31.

Here, on the inert gas layer 351, a low specific gravity gas layer 371 which includes a low specific gravity gas supplied from a low specific gravity gas supply device 37 and has a lower specific gravity than the inert gas layer 351 is formed. The low specific gravity gas is required to be a gas that is a different type from an inert gas, and be a gas having a lower specific gravity than that of the inert gas layer 351. For example, the low specific gravity gas is a predetermined gas heated to a temperature at which specific gravity of the low specific gravity gas becomes lower than that of the inert gas layer 351. In the present embodiment, the predetermined gas is air. Air is preferable in consideration of costs. However, since air contains water vapor, air is preferably dehumidified. Alternatively, the predetermined gas may be nitrogen gas. When nitrogen gas is used, it is more expensive than when air is used. However, the quality of nitrogen gas supplied from a gas cylinder or a nitrogen generation device is relatively stable. When the low specific gravity gas layer 371 is formed on the inert gas layer 351, it is possible to prevent the molten material 83 from reacting with oxygen and nitrogen in the air, and it is possible to reduce an amount of inert gas used.

Figure 4:
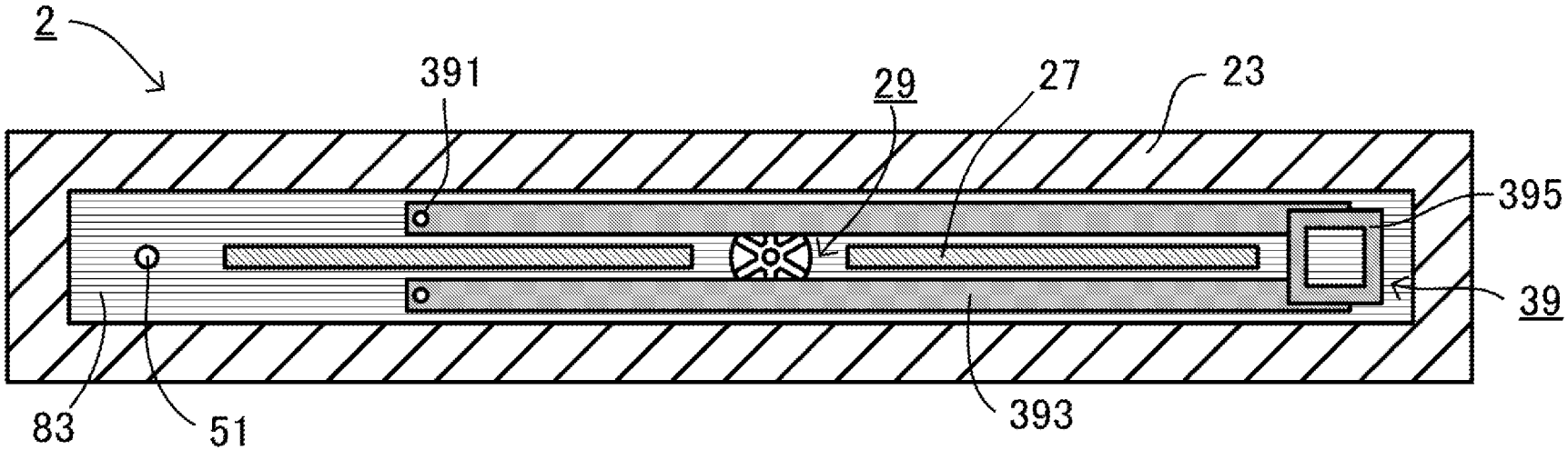
FIG. 4 is a cross-sectional view taken along arrows C-C in FIG. 1.

When the low specific gravity gas is a predetermined gas heated to a temperature at which the specific gravity becomes lower than that of the inert gas layer 351, a heating device configured to heat the predetermined gas and generate the low specific gravity gas is provided. Various forms of the heating device can be used as long as they can appropriately heat the predetermined gas, for example, an electric heater configured to heat air using a heating wire may be used. In the present embodiment, the heating device is a heat exchanger 39 that includes a supply port 391 through which the predetermined gas is supplied, a pipeline 393 provided in the melting cylinder 21 and configured to heat the predetermined gas sent from the supply port 391, and an outlet 395 through which the predetermined gas heated through the pipeline 393 is discharged into the melting cylinder 21. As shown in FIG. 1 and FIG. 4, the predetermined gas sent from the supply port 391 to the pipeline 393 is heated due to heat inside the melting cylinder 21 and is discharged from the outlet 395 provided in the vicinity of the material supply port 23 as the low specific gravity gas. According to the heat exchanger 39, since the predetermined gas can be heated using heat from the melting cylinder 21, the low specific gravity gas can be generated at lower cost. Here, the heater 25 and the heat insulation portion 251 are not shown in FIG. 4.

The low specific gravity gas is substantially uniformly supplied from the supply port 391 provided to surround the molding material 81. The supplied low specific gravity gas attempts to rise around the molding material 81, but the rising of the low specific gravity gas is stopped due to a pressure from external air. Thus, the low specific gravity gas heated by heat exchanger 39 functions as the low specific gravity gas layer 371 covering the inert gas layer 351. In other words, a gas barrier that prevents external air from entering due to a flow of the low specific gravity gas is formed. The amount of low specific gravity gas supplied may be an amount at which external air does not enter. In addition, a gap between the molding material 81 and the supply port 391 is preferably small in a range in which a low specific gravity gas is appropriately supplied in order to prevent leakage of an inert gas, and is designed according to the maximum size of the molding material 81 that is expected to be used.

A material supply device 6 supplies the molding material 81 from the material supply port 23. For example, as shown in FIG. 3, the material supply device 6 may be a device that includes an arm 611 holding the molding material 81 and a lifting device 613 configured to raise and lower the arm 611. The arm 611 holds the molding material 81 one by one. The lifting device 613 controls a height position and a lowering speed of the arm 611, and switches to start and stop of lowering of the arm 611. The molding material 81 held by the arm 611 is gradually lowered from the material supply port 23 and is gradually melted from a portion immersed in the molten material 83. In addition to the specific example described above, various forms of the material supply device 6 can be used, and a configuration in which the molding material 81 is partially melted and supplied in units of small amounts is preferable in order to prevent a rapid decrease in temperature in the vicinity of the material supply port 23.

Figure 5:
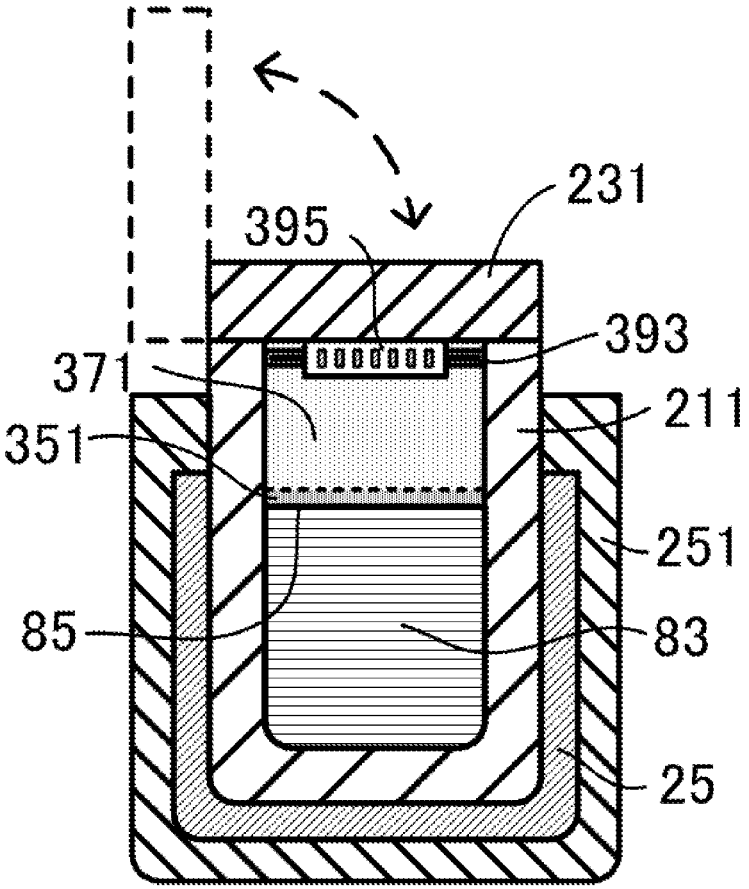
FIG. 5 is an explanatory diagram showing opening and closing of a material supply port lid 231.

In addition, as shown in FIG. 5, preferably, a material supply port lid 231 that can be opened and closed is provided on the material supply port 23. When the molding material 81 is not supplied, the material supply port lid 231 is closed, and thus it is possible to prevent leakage of the inert gas more appropriately. Here, when the material supply port lid 231 is closed, in order to prevent the internal pressure of the melting cylinder 21 from increasing, a gap with a size suitable for the material supply port lid 231 may be provided, or supply of the low specific gravity gas from the low specific gravity gas supply device 37 may be interrupted. In addition, if the material supply port lid 231 is not provided, it is possible to suitably prevent leakage of an inert gas by increasing an amount of low specific gravity gas supplied when the molding material 81 is not supplied.

In addition, a liquid level indicator 33 configured to measure a height of the melting surface 85 in the melting cylinder 21 is provided. As the liquid level indicator 33, indicators of various types such as a float type and a laser type can be used. The material supply device 6 supplies the molding material 81 such that the height of the melting surface 85 is within a predetermined range. Accordingly, it is possible to supply the molding material 81 without excess or deficiency and it is possible to prevent the lid 217 and the molten material 83 from coming in contact with each other.

The injection device 4 operates a plunger driving device 41 and retracts a plunger 43, and meters the molten material 83 sent from the melting cylinder 21 to the injection device 4 through the communication path 51 of the connecting member 5. The injection device 4 remains in a predetermined temperature range in which a state in which the molten material 83 is melted can be maintained by a plurality of heaters 47. After the injection device 4 meters the molten material 83, the communication path 51 is closed. Then, the injection device 4 operates the plunger driving device 41, and advances the plunger 43 to a predetermined position on the injection device 4. When the plunger 43 advances to the predetermined position, a predetermined amount of the molten material 83 in the injection device 4 is injected into a cavity of a mold (not shown) from an injection nozzle 45.

The connecting member 5 connects the melting cylinder 21 and the injection device 4. The melting cylinder 21 and the injection device 4 communicate in the communication path 51 in the connecting member 5. The connecting member 5 remains in a predetermined temperature range in which a state in which the molten material 83 is melted can be maintained by a heater 53.

A backflow prevention device 7 includes, for example, a valve seat 71 formed on an inner hole surface of the melting cylinder 21, a rod-shaped backflow prevention valve rod 73 that comes in contact with and separates from the valve seat 71, and a fluid cylinder 75 such as a hydraulic cylinder which is a valve rod driving device that is fixed to a side plate of the melting cylinder 21 and drives the backflow prevention valve rod 73 forward and backward. The communication path 51 is opened by the backflow prevention device 7 when a metering operation starts and is closed immediately before an injection operation is performed. Here, the backflow prevention device 7 may be provided in the injection device 4 or the connecting member 5, and valves known in the related art such as a check valve or a rotary valve may be used.

The invention described above is not limited to the above embodiments, and various modifications can be made based on the spirit and scope of the invention and they are not excluded from the scope of the invention. Particularly, specific devices having basic functions according to the spirit of the present invention are included in the present invention.

What is claimed is:

1. A melting device, comprising:

a melting cylinder that is heated to a predetermined temperature, melts a molding material supplied from a material supply port, and generates a molten material;

an inert gas layer on a melting surface of the molten material;

an inert gas supply device configured to supply an inert gas onto the melting surface of the molten material and form the inert gas layer;

a low specific gravity gas layer on the inert gas layer, having a lower specific gravity than the inert gas layer; and a low specific gravity gas supply device configured to supply a low specific gravity gas which is a gas having a different type from the inert gas and form the low specific gravity gas layer on the inert gas layer, wherein the melting device is a device of an injection molding machine, the low specific gravity gas is a predetermined gas heated to a temperature at which specific gravity of the low specific gravity gas is lower than specific gravity of the inert gas layer, and the low specific gravity gas supply device includes a heating device configured to heat the predetermined gas and generate the low specific gravity gas.

2. The melting device according to claim 1, wherein the molding material is a light metal.

3. The melting device according to claim 2, wherein the molding material is a magnesium alloy or an aluminum alloy.

4. The melting device according to claim 1, wherein the inert gas is argon gas.

5. The melting device according to claim 1, wherein the predetermined gas is air.

6. The melting device according to claim 1, wherein the predetermined gas is nitrogen gas.

7. The melting device according to claim 1, wherein the heating device is an electric heater.

8. The melting device according to claim 1, wherein the heating device is a heat exchanger that includes a supply port through which the predetermined gas is supplied, a pipeline provided in the melting cylinder and configured to heat the predetermined gas sent from the supply port, and an outlet through which the predetermined gas heated through the pipeline is discharged into the melting cylinder.

9. The melting device according to claim 1, further comprising:

an atmospheric component measuring device configured to measure at least one of an oxygen concentration, a nitrogen concentration, and an inert gas concentration of the inert gas layer, and a cooler provided between the melting cylinder and the atmospheric component measuring device and configured to cool the inert gas, wherein the inert gas supply device controls a supplied amount of inert gas such that a value detected by the atmospheric component measuring device is within a predetermined range.

10. The melting device according to claim 1, further comprising a material supply port lid that is provided on the material supply port and is openable and closable, wherein the material supply port lid is closed when the molding material is not supplied.

* * * * *